US006499948B1

(12) United States Patent
Iyer et al.

(10) Patent No.: US 6,499,948 B1
(45) Date of Patent: Dec. 31, 2002

(54) SHROUD AND AXIAL FAN THEREFOR

(75) Inventors: Vasanthi Iyer, Wilmington, DE (US); Richard Down, Jr., Pine Hill, NJ (US); George Hall, Philadelphia, PA (US)

(73) Assignee: Penn Ventilation, Inc., North Wales, PA (US)

( * ) Notice: Subject to any disclaimer, the term of this patent is extended or adjusted under 35 U.S.C. 154(b) by 0 days.

(21) Appl. No.: 09/779,033

(22) Filed: Feb. 7, 2001

Related U.S. Application Data

(60) Provisional application No. 60/180,903, filed on Feb. 7, 2000.

(51) Int. Cl.[7] ..... F01D 1/00

(52) U.S. Cl. ..... 415/220; 416/189; 416/192

(58) Field of Search ..... 415/173.1, 208.1, 415/207, 211.1, 220, 222, 223, 182.1; 416/189, 192

(56) References Cited

U.S. PATENT DOCUMENTS

| | | | | |
|---|---|---|---|---|
| 1,504,776 A | | 8/1924 | Nagler | |
| 2,117,416 A | | 5/1938 | Hagen | |
| 2,925,952 A | * | 2/1960 | Garve | 415/208.3 |
| 3,650,633 A | * | 3/1972 | Benoit | 415/143 |
| 4,120,616 A | * | 10/1978 | Dwyer et al. | 417/373 |
| 4,213,426 A | | 7/1980 | Longhouse | |
| 4,221,546 A | | 9/1980 | Papst et al. | |
| 4,225,285 A | | 9/1980 | Sturm | |
| 4,245,965 A | | 1/1981 | Brown | |
| 5,215,437 A | | 6/1993 | TeVelde et al. | |
| 5,547,339 A | | 8/1996 | Burgers | |
| 5,586,861 A | * | 12/1996 | Berger | 415/118 |
| 5,615,999 A | | 4/1997 | Sukup | |
| 5,803,709 A | * | 9/1998 | Matthews et al. | 415/182.1 |

* cited by examiner

*Primary Examiner*—Edward K. Look
*Assistant Examiner*—James M McAleenan
(74) *Attorney, Agent, or Firm*—Akin, Gump, Strauss, Hauer & Feld, L.L.P.

(57) ABSTRACT

A fan shroud for an axial flow fan comprises a generally annular main body having an inlet end, an outlet end, and an inner surface defining a fluid flow path between the inlet and outlet ends. The inner surface includes first and second conical sections that converge toward the outlet end and a diverging section that diverges toward the outlet end. The second conical section is located between the first conical section and the diverging section. With this arrangement, turbulent fluid flow through the fan shroud between the inlet end and outlet end is minimized. Preferably, a first converging angle of the first conical section with respect to a plane transverse to the direction of fluid flow at the inlet end is less than a second converging angle of the second conical section with respect to the plane.

22 Claims, 4 Drawing Sheets

SHROUD AND AXIAL FAN THEREFOR

CROSS REFERENCE TO RELATED APPLICATIONS

This application claims the benefit of U.S. Provisional Patent Application No. 60/180,903 filed Feb. 7, 2000 the subject matter of which is hereby incorporated by reference.

BACKGROUND OF THE INVENTION

The present invention is directed to fluid movers and, more specifically, to a shrouded axial flow fan for moving fluids, such as air, from a first location to a second location.

Ventilation systems used in many commercial settings are required, either by code or by functional specifications, to have certain minimum airflow rates. For example, in commercial buildings, a minimum level of airflow is required to maintain a healthy air quality within the building. Similarly, in other applications, such as clean rooms, a certain level of airflow must be maintained to allow adequate filtration and removal of airborne particulate.

In addition to the air flow rate provided by various fans, other factors can affect the selection of a particular fan shroud and fan for a specific location. A few additional factors commonly used to select an appropriate fan are the efficiency of the fan, the size of the motor required by the fan and the noise generated by the fan shroud and fan combination.

Airflow in conventional axial fans is generated along the outer radial edge of the fan blades, resulting in reduced airflow through the center region of the fan and increased air turbulence. The increased air turbulence reduces fan efficiency and increases the noise generated by the fan.

A fan shroud that surrounds the blades of a fan will generally improve the flow of air through the fan. However, the motor size, air flow efficiency, noise generated by the fan, and related factors continue to be problematic in the industry.

SUMMARY OF THE INVENTION

According to the invention, a fan shroud for an axial flow fan comprises a generally annular main body having an inlet end, an outlet end, and an inner surface defining a fluid flow path between the inlet and outlet ends. The inner surface includes first and second conical sections that converge toward the outlet end, and a diverging section that diverges toward the outlet end. The second conical section is located between the first conical section and the diverging section. With this arrangement, turbulent fluid flow through the fan shroud between the inlet end and outlet end is minimized. Preferably, a first converging angle of the first conical section with respect to a plane transverse to the direction of fluid flow at the inlet end is less than a second converging angle of the second conical section with respect to the plane.

Further according to the invention, an axial flow fan is positioned in the fan shroud. The axial flow fan includes a central hub and a plurality of fan blades extending radially from the hub. Preferably, the central hub is generally aligned with the second conical section.

Each fan blade has a first side that generally faces the inlet end and a second opposing side that generally faces the outlet end. The first side of each fan blade extends into the first conical section and the second side of each fan blade extends into the diverging section.

BRIEF DESCRIPTION OF THE SEVERAL VIEWS OF THE DRAWINGS

The preferred embodiments of the present invention will hereinafter be described in conjunction with the appended drawings, wherein like designations throughout the drawings denote like elements, and wherein.

DETAILED DESCRIPTION OF THE INVENTION

Figure 1:
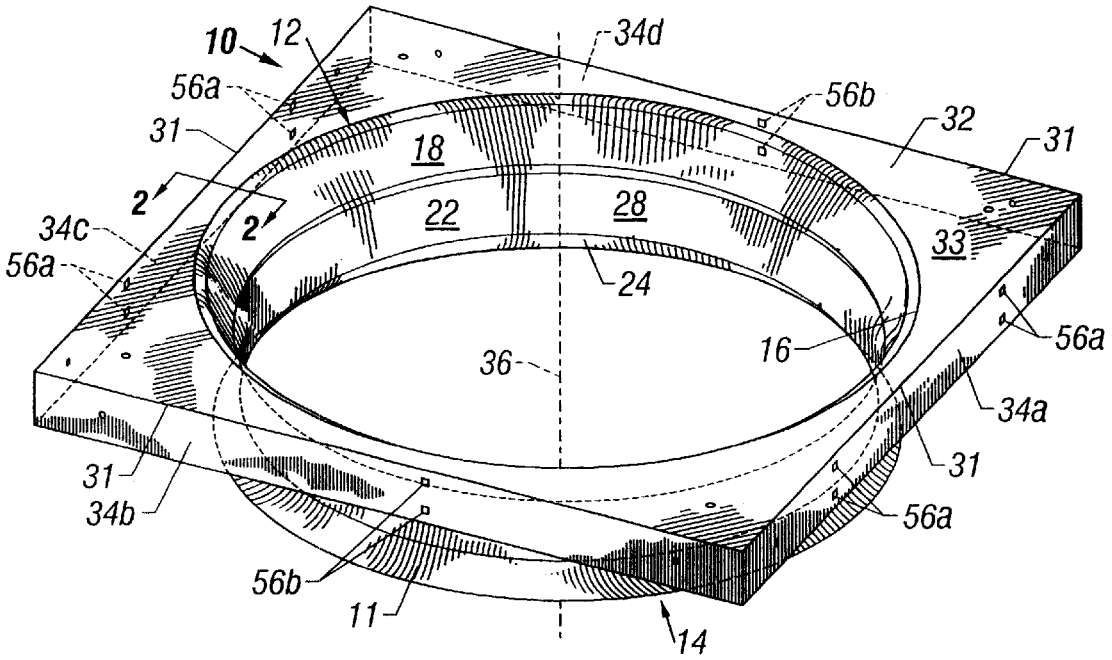
FIG. 1 is a perspective view of a fan shroud according to a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the combination axial fan and fan shroud and designated parts thereof. The terminology includes the words above specifically mentioned, derivatives thereof and words of similar import.

Figure 2:
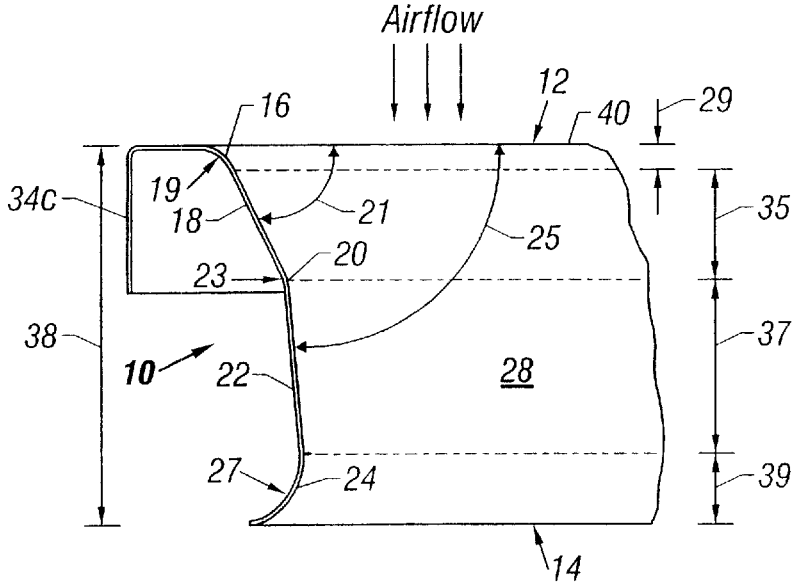
FIG. 2 is an enlarged cross-sectional view of a portion of the fan shroud taken along the line 2—2 of FIG. 1.

Referring now to the drawings, and to FIGS. 1 and 2 in particular, a preferred embodiment of a fan shroud 10 according to the present invention is illustrated. The fan shroud 10 is preferably in the form of a generally annular body 11 that is centrally positioned in a generally square-shaped bracket 32. The fan shroud 10 includes an inlet end 12 that is flush with an upper surface 33 of the bracket 32 and an outlet end 14 that extends away from the inlet end. While it is preferable that the inlet end 12 of the fan shroud 10 be flush with the upper surface 33 of the bracket, it will be appreciated that the bracket 32 can be attached along any portion of the length 38 of the fan shroud 10. Additionally, while it is preferable that the bracket 32 be integrally formed with the fan shroud 10, the bracket 32 and fan shroud 10 can be separately formed and joined together through welding, mechanical fastening, adhesive bonding, or other well-known fastening means.

The bracket 32 includes first, second, third and fourth lateral sides 34*a*, 34*b*, 34*c*, 34*d*, respectively, that extend from the edges 31 of the upper surface 33, preferably in the same direction as the fan shroud 10. Each lateral side 34*a*, 34*b*, 34*c*, 34*d* preferably, but not necessarily, extends along the entire length of its associated edge 31. The lateral sides 34*a*, 34*b*, 34*c*, 34*d* are preferably joined to each other along their longitudinal ends to generally form a generally square-shaped flange. A first set of fastener holes 56A are formed in the lateral sides 34*a* and 34*c*, while a second set of fastener holes 56B are formed in the lateral sides 34*b* and 34*d*. The fastener holes can be used to mount the fan shroud 10 to a mounting assembly 50 (FIG. 3), as will be described in greater detail below.

Referring now to FIG. 2, the cross-sectional profile of the inner surface 28 of the shroud 10 increases the amount of fluid flow that occurs through the center region of the fan shroud 10 and thereby reduces turbulent fluid flow and increases the efficiency of any fan which is mounted within the fan shroud 10. The inner surface 28 of the fan shroud 10 aids the fluid in flowing toward the outlet end 14 from the inlet end 12 in a less turbulent fashion to improve the fluid flow through the fan shroud 10.

The inner surface 28 preferably has an inlet converging section or first flared converging section 16. The first flared converging section 16 preferably has a radius of curvature 19 of approximately 0.5 inch for a fan shroud 10 having an axial length 38 of approximately 7.91 inches as measured parallel to the central axis 36 (FIG. 1). However, it will be appreciated that the radius of curvature can be varied between approximately 0.2 inch and approximately one (1) inch for a fan shroud 10 having an axial length 38 of approximately 7.91 inches without departing from the scope of the present invention.

After the first flared converging section 16, the inner surface 28 of the fan shroud 10 preferably forms a first conical converging section 18. The first conical converging section 18 preferably forms an angle 21 of approximately 65.7 degrees with an imaginary plane 40 that is coextensive with both the inlet end 12 and the upper surface 33 of the shroud 10. While it is preferable that the first conical converging section 18 form an angle 21 of approximately 65.7 degrees with the plane 40, it will be appreciated that the first conical converging section 18 can be configured to form an angle of between approximately 60 degrees and approximately 71 degrees with the plane 40 without departing from the scope of the present invention. Additionally, it will be appreciated that a more preferred range for the angle formed between the first conical converging section 18 and the plane 40 is between approximately 62 degrees and approximately 69 degrees.

After the first conical converging section 18, the inner surface 28 of the fan shroud 10 preferably forms an intermediate flared converging section 20. For a fan shroud 10 that has a length 38 of approximately 7.91 inches, the intermediate flared converging section 20 preferably has a radius of curvature 23 of approximately one (1) inch. However, it will be appreciated that the radius of curvature 23 of the intermediate flared converging section 20 can vary between approximately 0.5 inch and approximately 1.5 inches for the fan shroud 10 that has a length 38 of approximately 7.91 inches.

After the intermediate converging section 20, the inner surface 28 of the fan shroud 10 preferably forms a second conical converging section 22. The second conical converging section 22 preferably forms an angle 25 of approximately 86.2 degrees with the plane 40. However, it will be appreciated that the second conical converging section 22 can form an angle 25 of between approximately 71 degrees and approximately 89 degrees with the plane 40 without departing from the scope of the present invention. Additionally, a more preferred range for the angle formed between the second conical converging section 22 and the plane 40 is between approximately 83 degrees and approximately 89 degrees.

After the second conical converging section 22, the inner surface 28 of the shroud 10 preferably forms a flared diverging section 24. The flared diverging section 24, preferably has a radius of curvature 27 of approximately 1.44 inches for a fan shroud 10 having a length of approximately 7.91 inches as previously described. However, it will be appreciated from the present disclosure that the radius of curvature 27 of the flared diverging section 24 can be varied within the range of between approximately 0.5 inch and approximately 3 inches for a fan shroud 10 having a length 38 of approximately 7.91 inches, as previously described, without departing from the scope of the present invention.

Although the preferred length 38 of the fan shroud 10 is approximately 7.91 inches, it will be appreciated that the length 38 of the fan shroud 10 can be varied without departing from the scope of the present invention. It is preferable that the overall axial length of the converging portions of the fan shroud 10 (i.e., the first flared converging section 16, the first conical converging section 18, the intermediate converging section 20, and the second conical converging section 22 taken collectively) form between approximately 80 percent and approximately 95 percent of the axial length of the inner surface 28 of the fan shroud 10 as measured parallel to the central axis 36. It is more preferable, however, that the overall axial length of converging portions of the shroud 10 form between approximately 90 percent and approximately 94 percent of the axial length of the inner surface 28 of the fan shroud 10 as measured parallel to the central axis 36. It is even more preferable that the converging portions of the inner surface 28 of the fan shroud 10 occupy approximately 92 percent of the axial length of the fan shroud 10 as measured parallel to the central axis 36.

Accordingly, the first flared converging section 16 preferably has an axial length 29 of approximately 0.56 inch as measured parallel to the central axis 36 for a fan shroud 10 having a length 38 of approximately 7.91 inches. However, it will be appreciated that the axial length 29 of the first flared converging section 16 can be varied without departing from the scope of the present invention.

The axial length 35 of the first conical converging section 18 and the intermediate converging section 20 is preferably approximately 2.67 inches as measured parallel to the central axis 36 for a fan shroud 10 having a length 38 of approximately 7.91 inches. However, it will be appreciated that the axial length 35 of the first conical converging section 18 can be varied without departing from the scope of the present invention.

The second conical converging section 22 preferably has an axial length 37 of approximately 3.25 inches as measured parallel to the central axis 36 for a fan shroud 10 having a length 38 of approximately 7.91 inches. However, it will be appreciated that the relative axial length 37 of the second conical converging section 22 to the fan shroud 10 can be varied without departing from the scope of the present invention.

The flared diverging section 24 preferably has an axial length 39 of approximately 1.48 inches as measured parallel to the central axis 36 for a fan shroud 10 having a length 38 of approximately 7.91 inches. However, it will be appreciated that the flared diverging section 24 can have varying relative axial lengths 39 as compared to the fan shroud 10 without departing from the scope of the present invention.

The fan shroud 10 is preferably formed of deep spun sheet metal. The process of deep spinning sheet metal into various shapes is well known by those of skill in the art and accordingly is not further described herein. While it is preferable that the fan shroud 10 be formed of deep spun sheet metal, it will be appreciated that the fan shroud can be formed of any material that is suitably lightweight, strong, and durable. For example, the fan shroud 10 may be formed of sheet metal, stainless steel, galvanized metal, aluminum, a composite, an alloy, a polymer, or the like without departing from the scope of the present invention. The fan shroud 10 may be formed by stamping the sheet metal, molding, die casting or any other well-known forming process.

Additionally, while the fan shroud 10 is preferably formed as a continuous one-piece component, it will be appreciated from the present disclosure that the fan shroud 10 can be formed as separate components that are assembled together.

Figure 3:
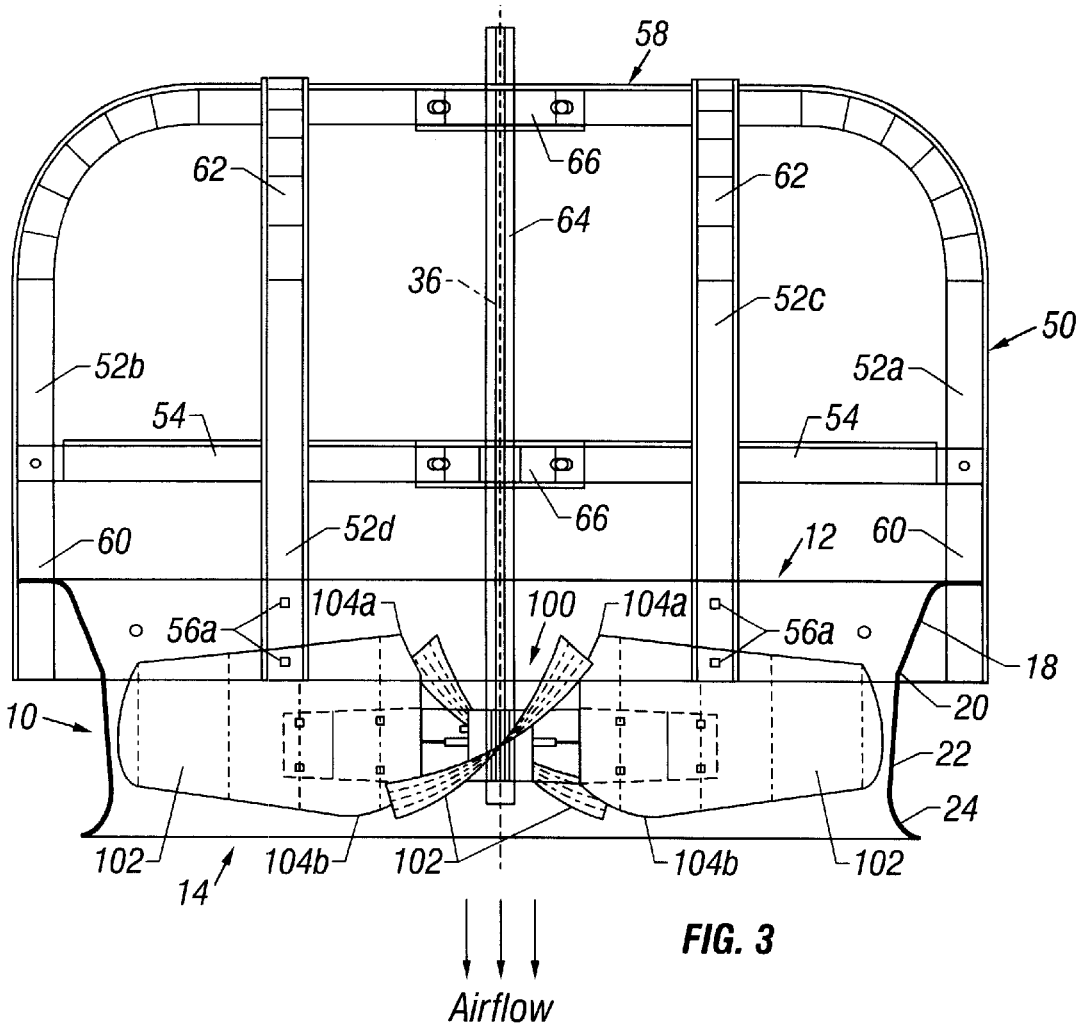
FIG. 3 is an elevational cross-sectional view of the fan shroud of FIG. 1 attached to a mounting system and enclosing an axial fan according to a preferred embodiment of the present invention.

Referring now to FIG. 3, the fan shroud 10 can be connected to a structural surface (not shown) through a mounting assembly 50. The mounting assembly 50 preferably includes a first beam 52A and a second beam 52B that together form a U-shaped member 58. The beams 52A and 52B are preferably U-shaped in cross section. However, it will be appreciated that the beams can have other cross sections. The U-shaped member 58 preferably includes legs 60 which are attached to the second and fourth lateral sides 34*b* and 34*d*, respectively, of the bracket 32.

With additional reference to FIG. 1, the legs 60 of the U-shaped member 58 are each preferably attached to one of the second sets of fastener holes 56B which are each positioned on the second and fourth sides 34*b*, 34*d*, respectively, of the bracket 32. The two sets of second fastener holes 56B are each preferably aligned generally centrally along the edge 31 of the bracket 32. Thus, once the U-shaped member 58 is attached to the second and fourth lateral sides 34*b*, 34*d* of the bracket 32, the U-shaped member 58 extends generally across and above the inlet 12 of the fan shroud 10. While it is preferable to connect the U-shaped member 58 to the bracket 32 using fasteners (not shown), it will be appreciated that other fastening means can be used, such as welding, adhesive bonding, and so on. At least one crossbeam 54 can extend between the legs 60 of the U-shaped member 58.

A third beam 52C and a fourth beam 52D are preferably attached to the first lateral side 34*a* of the bracket 32. Each beam 52C, 52D has a curved upper end 62 which is engaged with the U-shaped member 58. In an alternative arrangement, the curved upper ends 62 of the third and fourth beams 52C, 52D can be L-shaped.

Each beam 52C and 52D is attached to the lateral side 34*a* of the bracket 32. There are two sets of first fastener holes 56A located on the first lateral side 34*a* of the bracket 32. The two sets of first fastener holes 56A are preferably generally positioned on the first lateral side 34*a* approximately a distance of one quarter of the length of the edge 31 from the two adjacent corners of the bracket 32. Two additional beams (not shown) are preferably attached to the opposite third lateral side 34*c* of the fan shroud 10 from the third and fourth beams 52C, 52B in a generally symmetric manner and also engage the U-shaped member 58. While it is preferred that the beams 52A, 52B, 52C, and 52D and the two additional beams (not shown) are secured to the bracket 32 using fasteners, such as rivets, (not shown) it will be appreciated that other fastening means can be used, such as welding, adhesive bonding, a bolted gusset and so on.

The axial fan 100 is mounted to a shaft 64 for rotation therewith. The shaft 64 is in turn associated with an electric motor (not shown) or the like for rotating the shaft, and thus the axial fan 100. The shaft 64 is connected to the U-shaped member 58 through aligned brackets 66 on the U-shaped member 58 and the crossbeam 54 and extends generally along the central axis 36 into the fan shroud 10. Thus, the mounting system 50 provides support for both the fan shroud 10 and the axial fan 100. While a particular configuration for the mounting system 50 has been described, it will be appreciated that various alternative mounting systems can be used without departing from the scope of the present invention. For example, the bracket 32 of the shroud 10 can be directly attached to a vertical structure, such as a wall, without departing from the present invention.

Figure 5:
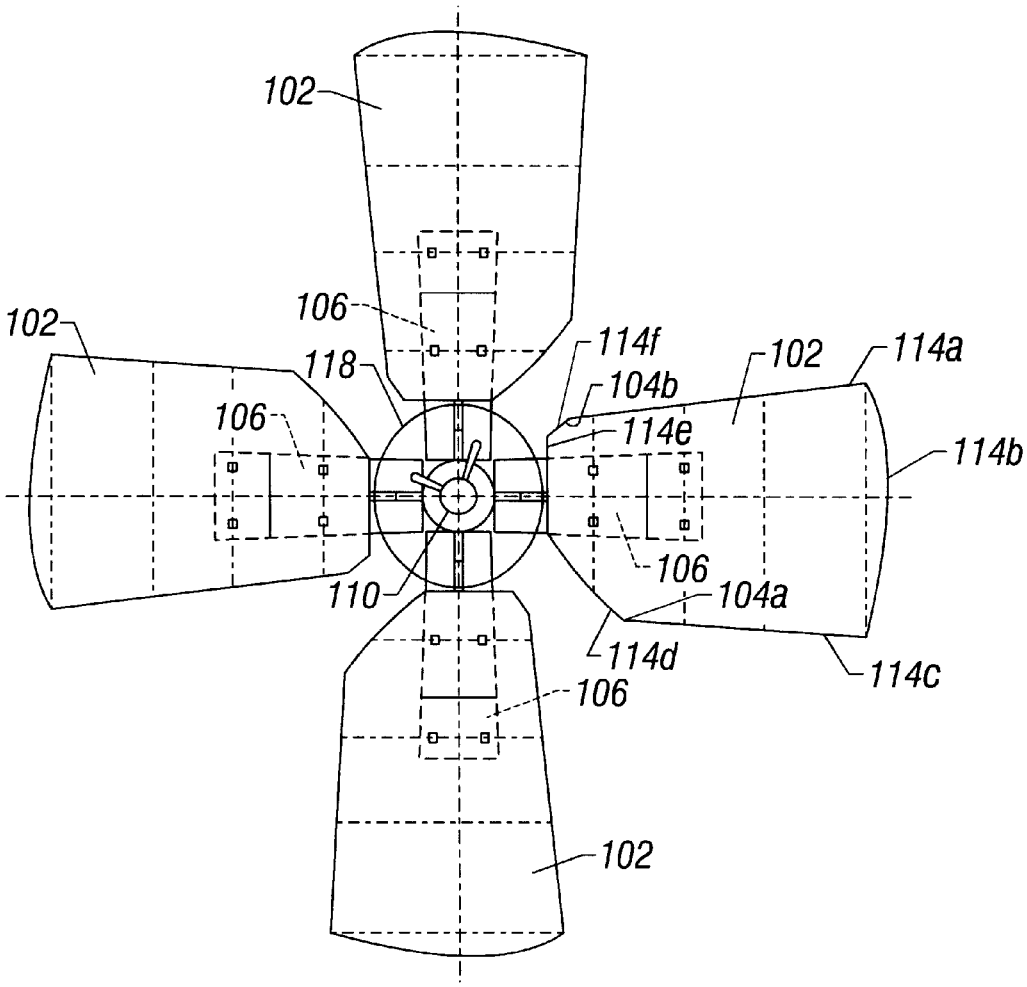
FIG. 5 is a top plan view of the fan of FIG. 3.

Referring to FIGS. 3 and 5, the axial fan 100 includes a central hub 110 that is positioned in the fan shroud 10, preferably generally aligned with the second conical converging section 22. However, it will be appreciated that the axial fan 100 can be generally positioned in any portion of the fan shroud 10 without departing from the scope of the present invention. A plurality of fan blades 102 are connected to the hub 110 through paddles 106. While four fan blades 102 are preferred, it will be appreciated that the axial fan 100 may have more or less fan blades. For example, an axial fan 100 may be constructed of two, three, five, six, seven, eight, or more fan blades. The fan blades 102 are preferably formed of stamped steel, but may be formed of stainless steel, galvanized steel, alloy, fiber glass, polymeric materials, composite materials, aluminum, or the like.

As shown, the fan blades and paddles extend generally radially and axially from the hub 110. Each fan blade preferably has first, second, third, fourth, fifth and sixth sides 114*a*, 114*b*, 114*c*, 114*d*, 114*e*, and 114*f*, respectively, with the sixth side 114*f* being the smallest in length. The relatively smaller size of the sixth side 114*f* effectively results in the fan blades 102 having a generally five-sided shape.

A first apex 104*a* is formed between the third and fourth sides 114*c* and 114*d*, respectively. A second apex 104*b* is formed between the first and sixth sides 114*f* and 114*a*, respectively. The first apex 104*a* extends into the first conical converging section 18 and the second apex 104*b* extends into the flared diverging section 24 when the hub 110 of the axial fan 100 is generally aligned with the second converging section 22. Preferably, there is a maximum clearance of about 0.25 inches between each fan blade and the second converging section 22 in order to maximize air flow efficiency. Of course, the maximum clearance may vary depending on the particular configuration of the fan 100 and fan shroud 10.

Figure 4:
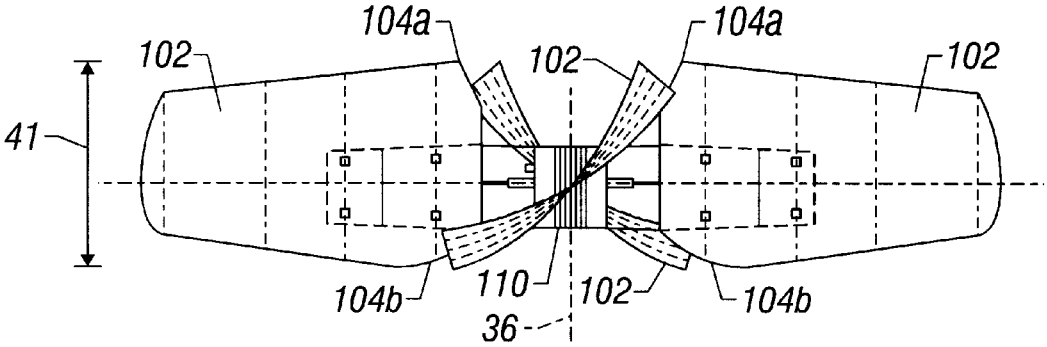
FIG. 4 is a side elevational view of the fan of FIG. 3.

As shown in FIG. 4, the fan blades 102 preferably have a height 41 between the first apex 104*a* and the second apex 104*b* of approximately 5.5 inches. However, it will be appreciated that fan blades 102 having a different height 41 can be used without departing from the scope of the present invention.

As previously described, each fan blade 102 is preferably attached to a paddle 106 which secures the fan blade 102 to the central hub 110. The paddles 106 are preferably slightly wedge-shaped with sides that slightly converge in a generally radial direction toward the central hub 110. It is preferable that the fan blades 102 are secured to the paddles 106 using rivets 108. However, other well-known fastening means, such as adhesive bonding or welding can be used to attach the fan blades 102 to the paddles 106. It will be appreciated that the size and shape of the paddles 106 can be varied. For instance, a centrally disposed longitudinal rib (not shown) could be added to the paddles 106 to increase the structural integrity of the same. A disk 118 is preferably positioned around the central hub 110 to receive the various paddles 106. According to an exemplary embodiment of the invention, the central hub has an outer diameter of approximately two inches and the disk 118 has a diameter of approximately five inches. However, it will be appreciated that the size and shape of the central hub 110 and the disk 118 can be varied. A slot 116 is formed in the disk 118 for each paddle 106. The paddles 106 are inserted into the slots and secured to the disk 118 in a well-known manner.

In a further embodiment, the paddles 106 can be omitted altogether and the blades 102 connected directly to the central hub 110.

Figure 6:
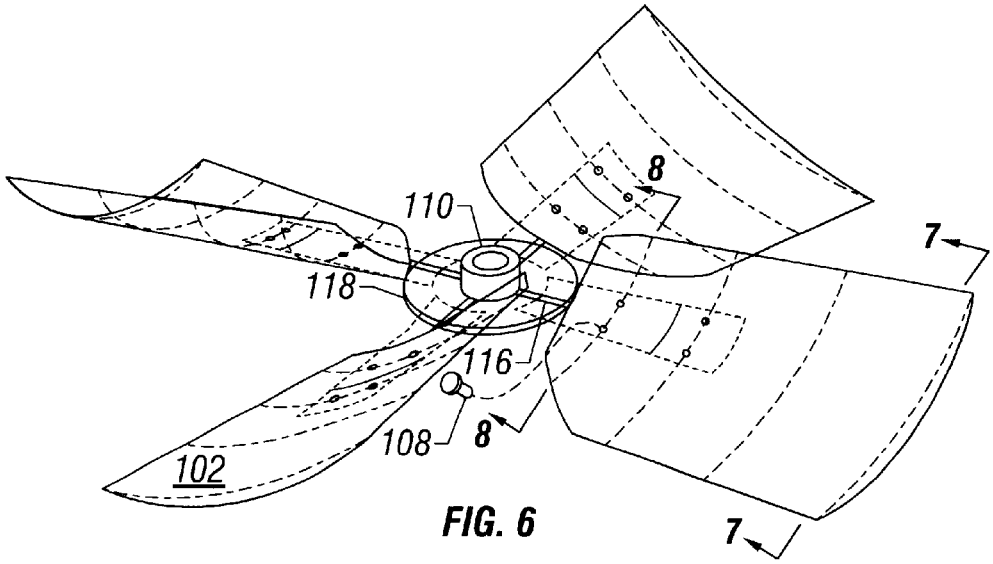
FIG. 6 is a perspective view of the fan of FIG. 3.

As shown most clearly in FIG. 6, the fan blades 102 have a curvature that encourages fluid flow through the center of the shroud 10. Thus, the axial fan 100 further reduces the turbulence when used in combination with the efficiency-improving shroud 10 of the present invention. The paddles 106 have a complementary curvature to that of the fan blades 102 and also improve the fluid flow through the center of the axial fan 100.

Figure 7:
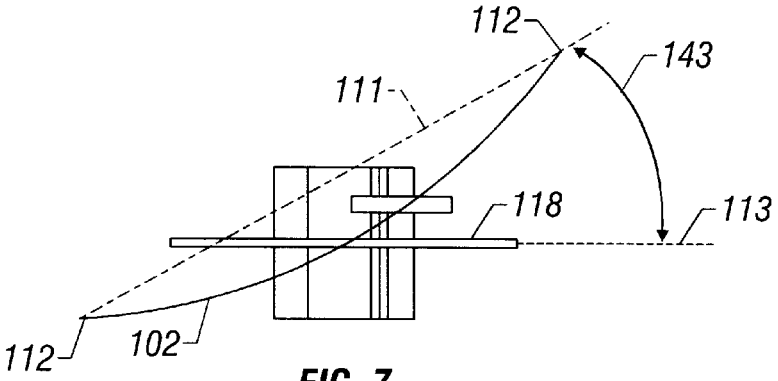
FIG. 7 is a cross-sectional view of a fan blade of the fan taken along line 7—7 of FIG. 6.

Referring now FIG. 7, a cross sectional view of the fan blade 102 taken along line 7—7 of FIG. 6 is illustrated. An imaginary line 111 extending between the edges 112 of the fan blade 102 preferably forms an angle 143 of approximately 28 degrees with a plane 113 of the disk 118. However, it will be appreciated that the angle formed by the line 111 relative to the disk 118 can be varied without departing from the scope of the present invention. Preferably, the pitch of the fan blade 102 and the paddle 106 is approximately 2.114 degrees per inch. However, it is to be understood that the specific pitch of the fan blade 102 and the paddle 106 can be varied without departing from the scope of the present invention.

Figure 8:
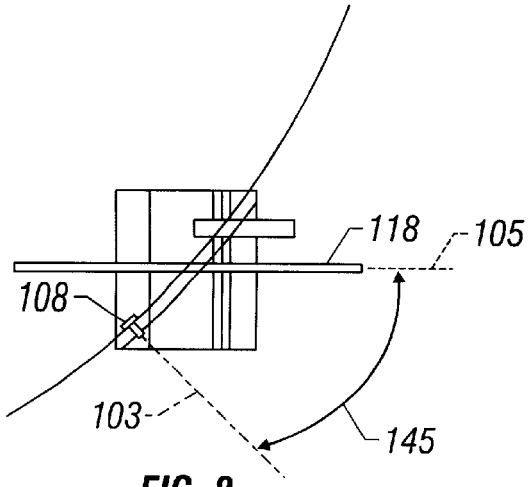
FIG. 8 is a cross-sectional view of a fan blade as taken along line 8—8 of FIG. 6.

With further reference to FIG. 8, a cross sectional view of the fan blade 102 taken along line 8—8 of FIG. 6 is illustrated. The curvature of the fan blade 102 causes a an axis 103 of a fastener 108 to preferably form an angle 145 of approximately 50.9 degrees with a plane 105 the disk 118. However, it will be appreciated that the angle 145 between the lower fastener 108 and the disk 118 can be varied without departing from the scope of the present invention.

In operation, and with reference to FIG. 3, a fan motor (not shown) is actuated and the fan blades 102 rotate to draw fluid into the fan shroud 10 via the inlet end 12. Due to the shape of the fan shroud 10, the fan blades 102 and the paddles 106, the fluid is drawn through the central region of the shroud with relatively low or no turbulence. This results in an increase in fluid flow and efficiency for the combination fan shroud 10 and axial fan 100. As the fluid is drawn into the fan shroud 10, the fluid flows sequentially through the first flared converging section 16, the first conical converging section 18, the intermediate converging section 20, the second conical converging section 22 and the flared diverging section 24. Then, the fluid is expelled from the fan shroud via the outlet 2 end 14. The profile of the inner surface 28 of the fan shroud 10 results in a higher efficiency combination fan shroud 10 and axial fan 100. Accordingly, the fan shroud 10 effectively enhances the performance of any fan contained therein. Additionally, the particular configuration of the fan blades 102 and the paddles 106 also tends to increase the flow of air through the center region of the fan shroud.

A prior art system designed to move air at the rate of 25,000 cubic feet per minute (cfm) with a static pressure of 0.100 iwg was compared to a combination shroud and axial flow fan system as described above. The prior art system required an electric motor with at least 5.24 brake horsepower (bhp) and operated at a noise level of 38 sones. The system according to the present invention included an axial flow fan with a diameter of approximately 36 inches for moving air through the fan shroud at the 25,000 cfm rate with the 0.100 iwg static pressure. The system of the present invention greatly increased the efficiency of airflow when compared to the prior art system by reducing turbulence through the fan shroud and distributing airflow more evenly across the fan shroud. The greater air handling efficiency of the present invention enabled the use of a smaller electric motor (approximately 2.74 bhp) with a noise level of approximately 25 sones. Thus, the system of the present invention achieved a reduction in required bhp by approximately 47% and a reduction in noise level of approximately 34% over the prior art system at the same air flow rate and static pressure. A cost savings of about 28% over the prior art system was also realized, due at least in part to the lower costs associated with a smaller electric motor, lighter gage wiring, smaller circuit breakers, and lower ampacity electrical distribution boxes. Further reduction in costs over the prior art may be realized by the use of a smaller transformer that supplies electrical power to a building, especially when numerous systems according to the present invention are installed in the building. Although an exemplary electric motor size, fan diameter, and other dimensions have been given, it is to be understood that the motor size, fan diameter and other dimensions can vary, depending on the fluid handling requirements of a particular application.

Thus, the combination fan shroud 10 and axial fan 100 results in a higher efficiency fluid moving system which does not require as large a motor as prior art axial fan and fan shroud combinations and which produces a reduced amount of noise. It will be appreciated that the fan shroud 10 can be used separately from the axial fan 100 without departing from the spirit and scope of the present invention. Similarly, it will be appreciated that the axial fan 100 can be used separately from the fan shroud 10.

It is to be understood that the various representative dimensions for the fan shroud 10 and the axial fan 100 as shown and described are given by way of example only. The representative dimensions illustrate only the relative proportions of the preferred embodiment of the fan shroud and fan. It is to be understood that the overall diameter of the fan shroud and fan can be varied without departing from the spirit and scope of the present invention, provided that the proper blade-ip clearances and geometry of the shroud are maintained.

Moreover, while the particular configuration, curvature and overall shape of the fan blades 102 of the improved axial fan 100 are shown, it will be appreciated that the configuration of the fan blades 102 can be varied without departing from the scope of the present invention.

While the fan shroud 10 is preferably used with an axial fan 100 as described above, it will be appreciated that the present invention is not limited thereto.

While the invention has been taught with specific reference to the above-described embodiments, those skilled in the art will recognize that changes can be made in form and detail without departing from the spirit and scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope

What is claimed is:

1. A fan shroud for an axial flow fan, the shroud comprising:

a generally annular body having an inlet end, an outlet end, and an inner surface defining an axial fluid flow path between the inlet and outlet ends;

the inner surface comprising:

a first conical section that converges toward the outlet end;

a diverging section that diverges toward the outlet end; and a second conical section that converges toward the outlet end, the second conical section being located between the first conical section and the diverging section;

whereby turbulent fluid flow through the shroud between the inlet end and outlet end is minimized.

2. A fan shroud according to claim 1, wherein a first converging angle of the first conical section with respect to a plane transverse to the direction of fluid flow at the inlet end is less than a second converging angle of the second conical section with respect to the plane.

3. A fan shroud according to claim 2, and further comprising an intermediate converging section extending between the first and second conical sections.

4. A fan shroud according to claim 3, wherein the intermediate converging section is curved to thereby reduce turbulent fluid flow between the first and second conical sections.

5. A fan shroud according to claim 4, and further comprising an inlet converging section extending from the inlet end to the first conical section.

6. A fan shroud according to claim 5, wherein the inlet converging section is curved to thereby reduce turbulent fluid flow between the inlet end and the first conical section.

7. A fan shroud according to claim 6, wherein the diverging section is curved to thereby reduce turbulent fluid flow between the second conical section and the outlet end.

8. A combination fan shroud and axially flow fan according to claim 2, wherein an axial length of the first and second conical sections and the intermediate converging section is in the range of about 80 percent to about 95 percent of the axial length of the fan shroud.

9. A fan shroud according to claim 1, and further comprising an intermediate converging section extending between the first and second conical sections.

10. A fan shroud according to claim 9, wherein the intermediate converging section is curved to thereby reduce turbulent fluid flow between the first and second conical sections.

11. A fan shroud according to claim 1, and further comprising an inlet converging section extending from the inlet end to the first conical section.

12. A fan shroud according to claim 11, wherein the inlet converging section is curved to thereby reduce turbulent fluid flow between the inlet end and the first conical section.

13. A fan shroud according to claim 1, wherein the diverging section is curved to thereby reduce fluid flow between the second conical section and the outlet end.

14. A fan shroud according to claim 1, and further comprising a generally square-shaped bracket member formed integrally with the main body.

15. A combination fan shroud and axially flow fan according to claim 1, wherein an axial length of the first and second conical sections is in the range of about 80 percent to about 95 percent of the axial length of the fan shroud.

16. In combination, a fan shroud according to claim 1 and an axial flow fan positioned in the fan shroud, the axial flow fan comprising:

a central hub; and a plurality of fan blades connected to the hub and extending generally radially therefrom.

17. A combination fan shroud and axial flow fan according to claim 16, wherein the central hub is generally aligned with the second conical section.

18. A combination fan shroud and axial flow fan according to claim 17, wherein each fan blade has a first side generally facing the inlet end and a second opposing side generally facing the outlet end, with the first side extending into the first conical section and the second side extending into the diverging section.

19. A combination fan shroud and axially flow fan according to claim 18, wherein a first converging angle of the first conical section with respect to a plane transverse to the direction of fluid flow at the inlet end is less than a second converging angle of the second conical section with respect to the plane.

20. A combination fan shroud and axially flow fan according to claim 16, wherein a first converging angle of the first conical section with respect to a plane transverse to the direction of fluid flow at the inlet end is less than a second converging angle of the second conical section with respect to the plane.

21. A combination fan shroud and axially flow fan according to claim 20, wherein an axial length of the first and second conical sections is in the range of about 80 percent to about 95 percent of the axial length of the fan shroud.

22. A combination fan shroud and axially flow fan according to claim 16, wherein an axial length of the first and second conical sections is in the range of about 80 percent to about 95 percent of the axial length of the fan shroud.

* * * * *